US011806992B2

(12) United States Patent
Arteaga et al.

(10) Patent No.: US 11,806,992 B2
(45) Date of Patent: Nov. 7, 2023

(54) SENSOR SUPPORT WITH BIASED SECTION

(71) Applicant: Hewlett-Packard Development Company, L.P., Spring, TX (US)

(72) Inventors: Pablo Arteaga, Sant Cugat del Valles (ES); Carles Flotats Villagrasa, Sant Cugat del Valles (ES); David Melero Cazorla, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/419,077

(22) PCT Filed: Sep. 4, 2019

(86) PCT No.: PCT/US2019/049511
§ 371 (c)(1),
(2) Date: Jun. 28, 2021

(87) PCT Pub. No.: WO2021/045741
PCT Pub. Date: Mar. 11, 2021

(65) Prior Publication Data
US 2022/0184976 A1 Jun. 16, 2022

(51) Int. Cl.
*B41J 11/00* (2006.01)
*B41J 11/06* (2006.01)
*B41J 29/46* (2006.01)

(52) U.S. Cl.
CPC ..... *B41J 11/0095* (2013.01); *B41J 11/06* (2013.01); *B41J 29/46* (2013.01)

(58) Field of Classification Search
CPC ..... B41J 11/0095; B41J 11/06; B41J 29/46
See application file for complete search history.

(56) References Cited

U.S. PATENT DOCUMENTS

| | | | | |
|---|---|---|---|---|
| 6,330,424 | B1 | 12/2001 | Chapman et al. | |
| 6,905,187 | B2 | 6/2005 | Arquilevich | |
| 7,611,299 | B2 | 11/2009 | Ochiai et al. | |
| 8,016,504 | B2 | 9/2011 | Tsuchiuya et al. | |
| 8,123,327 | B2 | 2/2012 | Casaldaliga et al. | |
| 2009/0016796 | A1* | 1/2009 | Tsuchiya | B41J 2/32 400/120.16 |
| 2009/0102870 | A1* | 4/2009 | Wanibe | B41J 2/17523 347/7 |
| 2013/0135407 | A1* | 5/2013 | Abe | B41J 11/42 347/102 |
| 2019/0118479 | A1 | 4/2019 | Sala Roura et al. | |

FOREIGN PATENT DOCUMENTS

| | | |
|---|---|---|
| RU | 2215657 | 11/2003 |

OTHER PUBLICATIONS

HP Latex Knowledge Center, Discover the Optical Media Advance Sensor (OMAS) behind HP Latex technology, Oct. 13, 2016, 4 pages.

* cited by examiner

*Primary Examiner* — Henok D Legesse

(57) ABSTRACT

A sensor support, as well as a platen and printer for use with the sensor support. The sensor support comprising a first section and a second section. The first section is capable of receiving a sensor. The first section and the second section are associated together such that there is at least a degree of freedom of movement of the first section relative to the second section. The sensor support further comprises biasing means to urge the first section away from the second section.

15 Claims, 7 Drawing Sheets

SENSOR SUPPORT WITH BIASED SECTION

BACKGROUND

The quality of a print can be influenced positively or negatively by the accuracy of substrate advance in a printer system.

BRIEF DESCRIPTION OF THE DRAWINGS

Example implementations will now be described, by way of example, with reference to the accompanying drawings in which.

DETAILED DESCRIPTION

Figure 1:
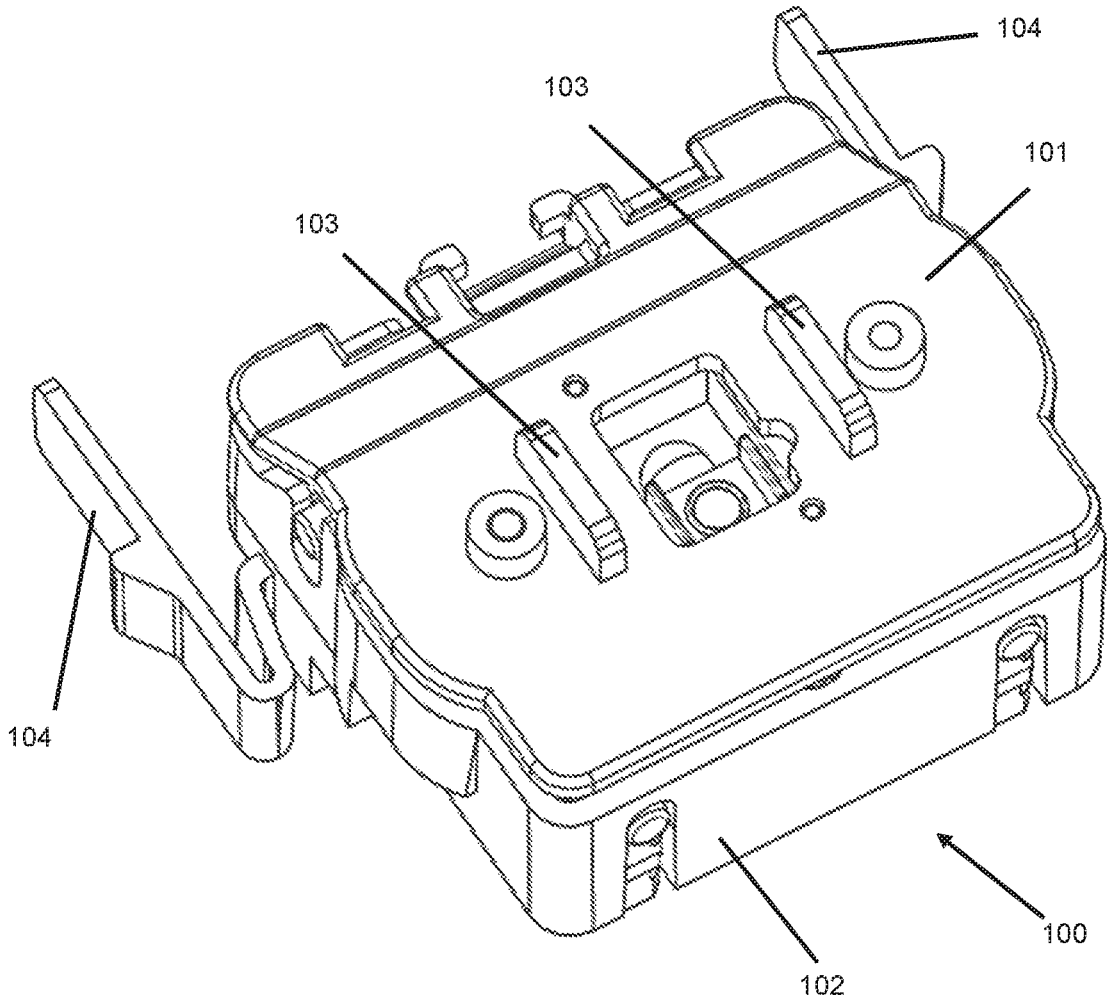
FIG. 1 is a schematic view of a sensor support according to example implementations.

FIG. 1 shows an assembled sensor support 100. The sensor support 100 comprises a first section 101 and a second section 102. The first section 101 is arranged to sit within the second section 102, although it will be readily apparent that the first section 101 may sit without the second section 102 or that neither section need be located within one another. The sensor support 100 may be constructed of any suitable material such as, but not limited to, a plastic or metal.

The assembled sensor support 100 houses and protects a sensor apparatus 201 from inadvertent contact upon removal of a platen by an end user.

The first section 101 is provided with one or more grips 103 arranged on a surface intended to interface with a platen. The one or more grips 103 replaceably locate and place the first section 101 adjacent the platen such that the first section 101, when the grips 103 are interfaced with the platen, is substantially always in the same position with respect to the platen. It will be apparent that any number of grips 103 may be used, and these may be arranged in any suitable location on the first section 101 provided the grips 103 provide the function of replaceably locating the first section 101 in substantially the same position relative to the platen, when the grips 103 are interfaced with the platen. It will be apparent that any protrusion may serve the purpose of a grip, provided the protrusion provides the function of replaceably locating the first section 101 in substantially the same position relative to the platen, when the protrusion is interfaced with the platen.

The second section 102 is provided with resilient clips 104 arranged to releasably connect, and/or snap fit the second section 102 with a structure, such as but not limited to, a printer chassis, frame, printer, or case. Other alternatives may be selected instead of clips, these may or may not be releasable, such as one-way snap-fit connectors, screws and eyelets, or rivets. In the further alternative the second section 102 may be integrally formed with the structure. Use of the term structure herein refers to a larger part forming all or part of a greater apparatus, such as but not limited to, a printer.

Figure 2:
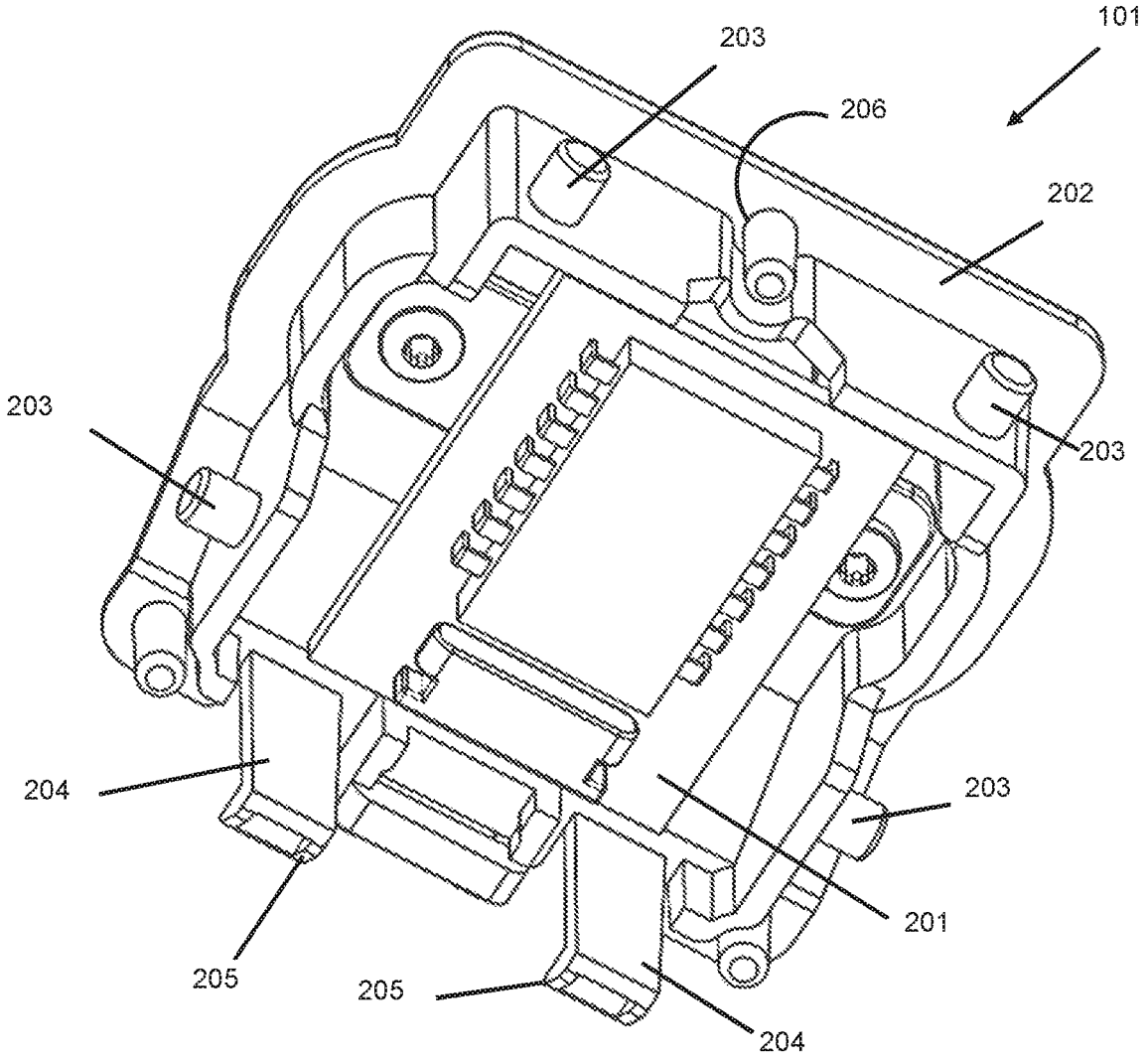
FIG. 2 depicts a first section of a sensor support according to example implementations.

With reference to FIG. 2, the first section 101 is shown in greater detail. The first section 101 comprises a first section body 202. The body 202 is provided with guides 203 which in this example are arranged at a periphery of the body 202, although it will be apparent that the guides 203 may be located in any suitable location of the first section body 202, provided that the guides 203 may interface with second section 102 slots (discussed later). A sensor apparatus 201 (also referred to as a sensor, but this can comprise a printed circuit board, and sensor driver components as well as one or more sensors) is attached to the first section 101. The sensor apparatus 201 may be integrally formed with the first section 101 or releasably attached thereto. The purpose of the first section 101 is to hold the sensor apparatus 201. The first section 101 should therefore not obscure or hinder operation of the sensor.

The first section 101 is further provided with teeth 204 arranged to attach to the second section 102. The teeth 204 may freely slide within an aperture of the second section 102, while a tang 205 arranged upon the one or more teeth 204 provides a back stop such that movement of the first section 101 relative to the second section 102 is bounded by the travel of the one or more teeth 204 within the aperture of the second section 102. It will be apparent that the one or more teeth 204 need not be arranged on the first section 101, but alternatively may be arranged on the second section 102 with a corresponding aperture on the first section 101. It will also be apparent that the arrangement of teeth 204 and apertures may alternate between the first and section sections (i.e. the first section 101 comprises both teeth 204 and apertures corresponding to respective apertures and teeth on the second section 102). The one or more teeth 204 are typically formed of a resilient plastic, however any suitable material may be selected.

Figure 3:
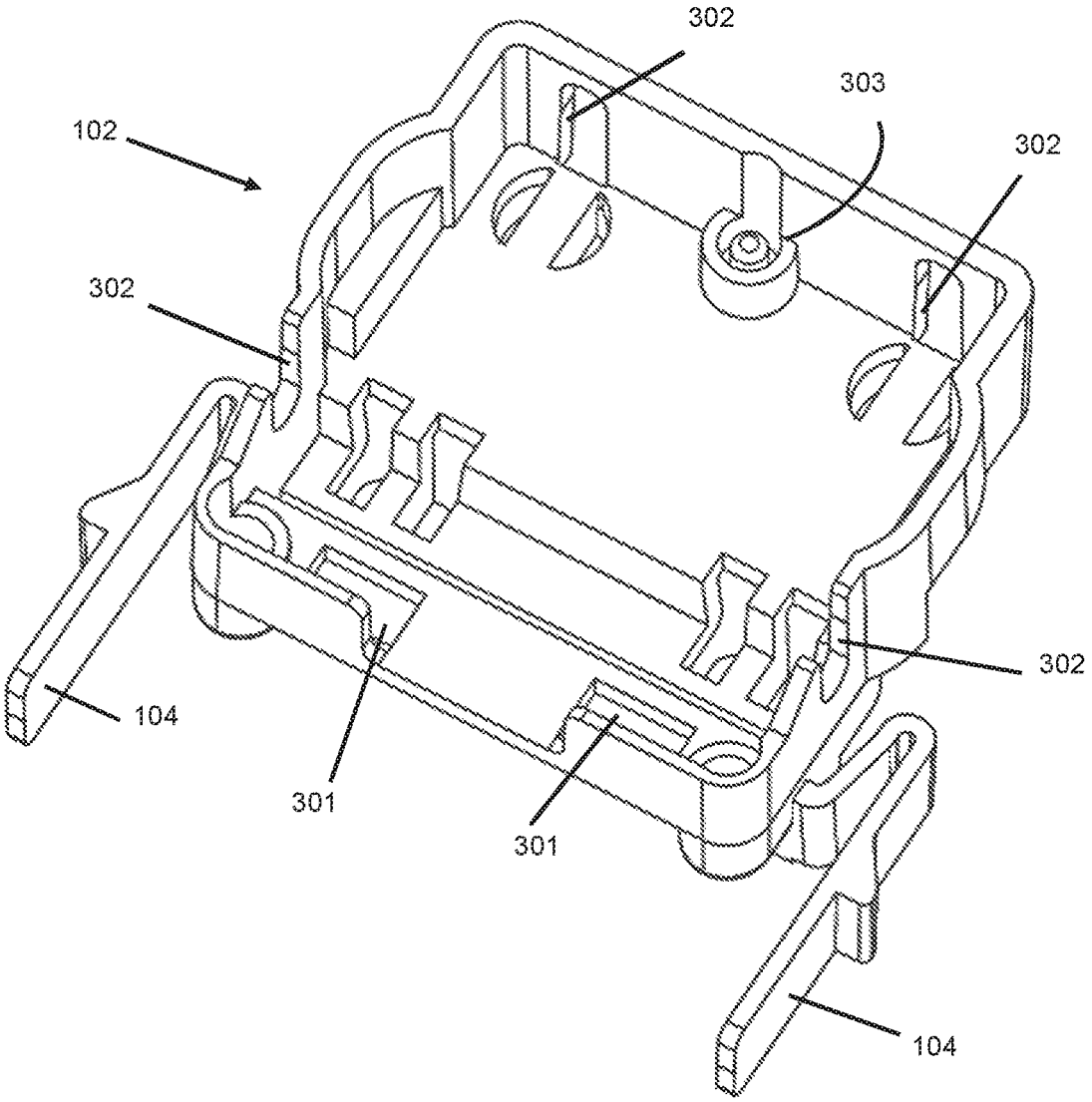
FIG. 3 depicts a second section of a sensor support according to example implementations.

With reference to FIG. 3 there is shown in greater detail a second section 102 comprising one or more apertures 301 corresponding to the teeth 204 of the first section 101, one or more resilient clips 104, one or more guide slots 302. The second section 102 further comprises at least one housing 303 for one or more biasing means. Complimentary housing 206 are also provided on the first section 101 to receive the one or more biasing means, such that the biasing means are sandwiched between the first and second sections 101, 102.

The biasing means functions to urge the first section 101 away from the second section 102. As the second section 102 is fixed in place upon a structure of a greater apparatus, when the first section 101 is interfaced with a platen, the biasing means urge the first section 101 towards the platen creating an interference fit between the first section 101 and platen. The grips 103 of the first section 101 locate and arrange the platen in substantially the same position relative to the platen. The respective guides and slots 302 of the first and second sections 101, 102 allow the first section 101 sufficient travel from the second section 102 to abut the platen. In the instance the platen is not placed substantially parallel to the body 202 of the first section 101 (or a part of the body 202 intended to abut the platen), the guides 203 and slots 302 allow for a degree of translational and rotational movement of the first section 101 relative to the second section 102. The degree of translational and rotational movement sufficient to abut the first section 101 to the platen and allow the grips 103 and biasing means to locate and arrange the sensor 201 in substantially the same position relative to the platen irrespective of multiple removal and replacement routines of the platen by an end user. It is noted that the end user may be a technician providing a service function, or alternatively an end user of the greater apparatus such as but not limited to, a person commissioning a print upon a printer.

Figure 4:
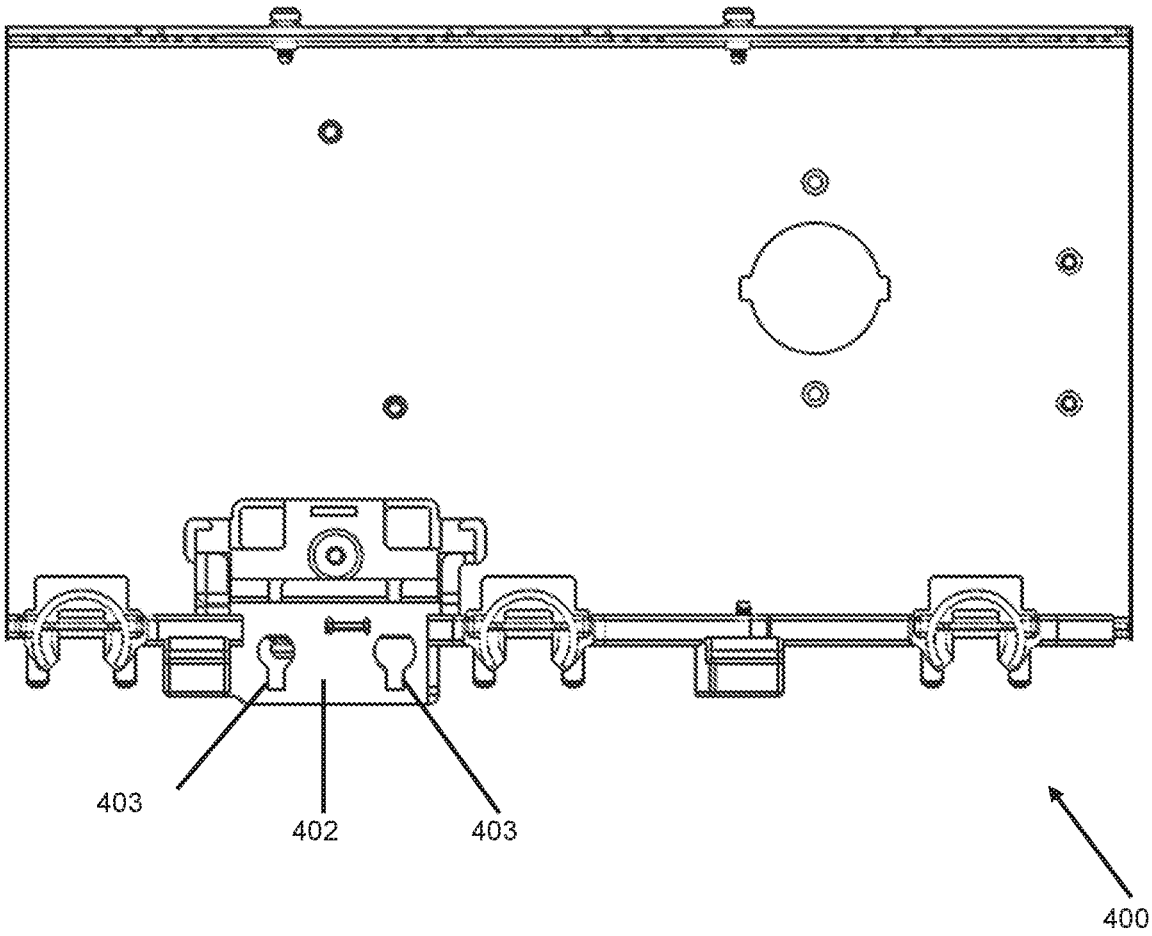
FIG. 4 illustrates a structure capable of receiving a sensor support according to example implementations.

With reference to FIG. 4 there is shown a larger part 400 of a greater apparatus. In this example the larger part 400 provides a platform 401 onto which a structure 402 is attached. The structure 402 comprises reference points 403 to locate the second section 102 as well as to receive the resilient clips 104 to attach the second section 102 to the structure 402. The structure 402 should locate the sensor support 100 within a suitable distance of the platen so that the sensor support 100 can fulfil its function of replaceably repositioning the sensor relative to the platen upon repeated removal and replacement of the platen.

Figure 5:
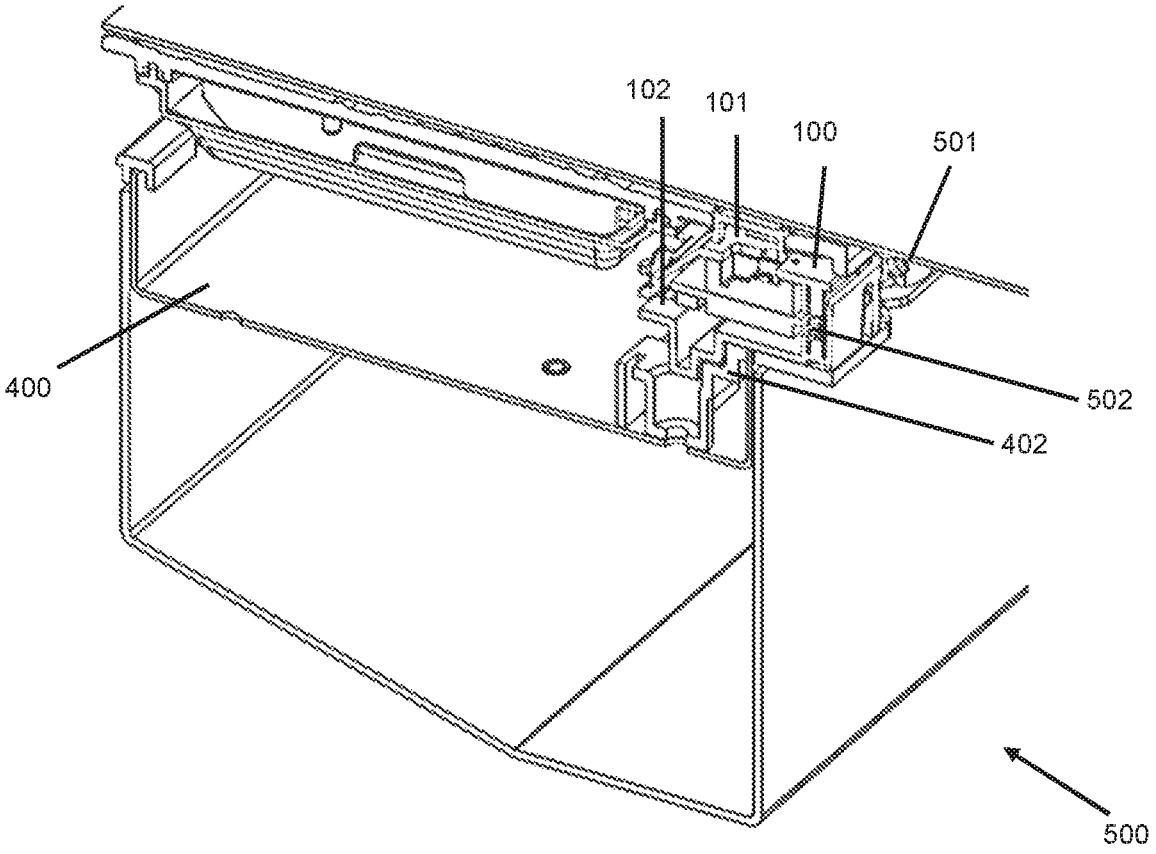
FIG. 5 shows a cross section of a device comprising a sensor support according to example implementations.

With reference to FIG. 5 there is shown a greater apparatus 500, typically, but not exclusively, a printer. The printer comprises a removable platen 501, a larger part 400, and a structure 402. Attached to the structure 402, and abutting the platen 501 is a sensor support 100. A biasing means 502 urges the first section 101 of the sensor support 100 away from the second section 102. The second section 102 is held in a fixed position relative to the structure 402, therefore the first section 101 moves towards the platen 501.

In examples the sensor support 100 is installed below the platen 501 to ensure that the focal distance between the sensor and print media is obtained from the contact of the media and the platen 501.

With reference to FIGS. 6A, 6B, 6C, and 6D there is shown a process of removing the platen 501 and accordingly, the operation of the sensor support 100 during platen 501 removal.

Figure 6A:
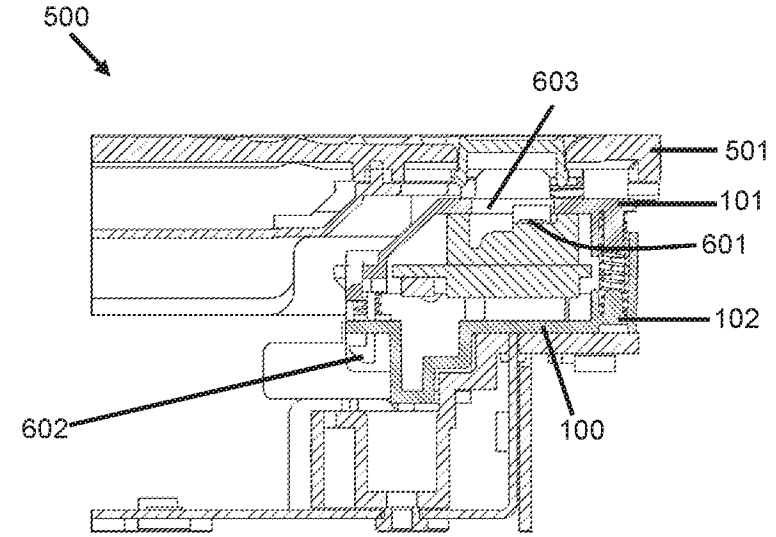
FIGS. 6A to 6D illustrate an operation of a sensor support according to example implementations.

FIG. 6A shows the platen 501 installed within the greater apparatus 500 in a position ready for use. The sensor support 100 is arranged on the structure 402 and the second section 102 is fixed in place. The first section 101 abuts the platen 501 and places the sensor 601 in substantially the same position relative to the platen 501. It can be observed that a tooth 602 is engaged with a respective aperture in the second section 102, and that the tooth 602 passes through the aperture substantially halfway along the length of the tooth 602.

Figure 6B:
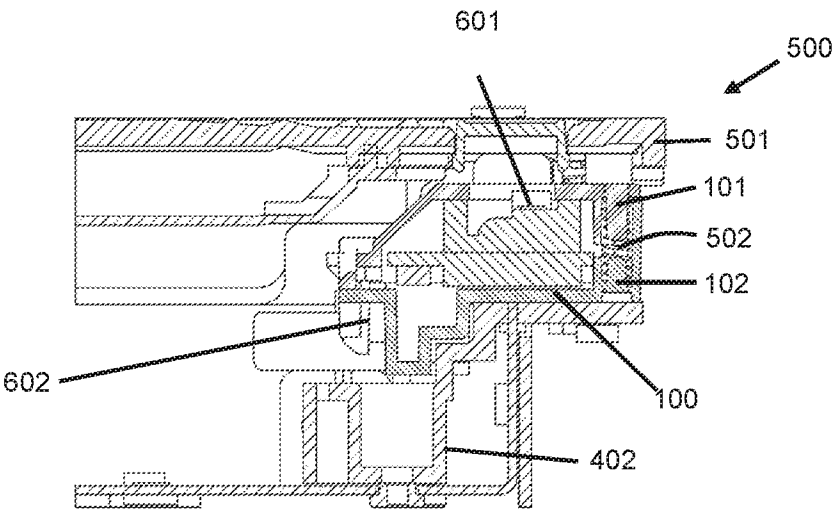

FIG. 6B illustrated the first stage in removing the platen 501. The platen 501 is depressed relative to the structure 402. This compresses the biasing means 502 and the first section 101 moves relatively closer to the second section 102. The depression of the platen 501 releases tension on, and uncouples, attachments associating the platen 501 with the greater apparatus 500. In this stage the grips 103 of the first section 101 remain interfaced with corresponding location points on the platen 501 and the sensor 601 remains substantially in the same position with respect to the platen 501. Here the tooth 602 passes through the aperture towards an extreme end of the degree of freedom of movement. The first and second sections 101, 102 are arranged relatively close to one another.

Figure 6C:
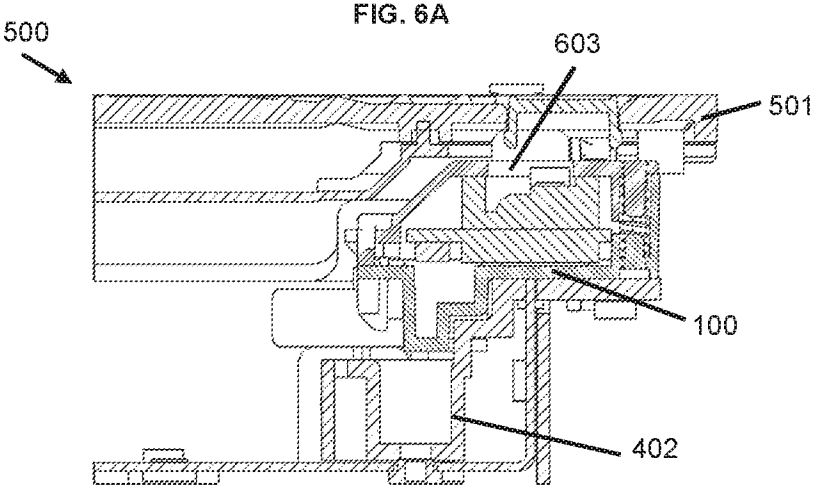

In FIG. 6C the platen 501 is translationally shifted relative to its initial position with respect to the structure 402. Here the grips 103 of the first section 101 have now disengaged with the platen 501.

Figure 6D:
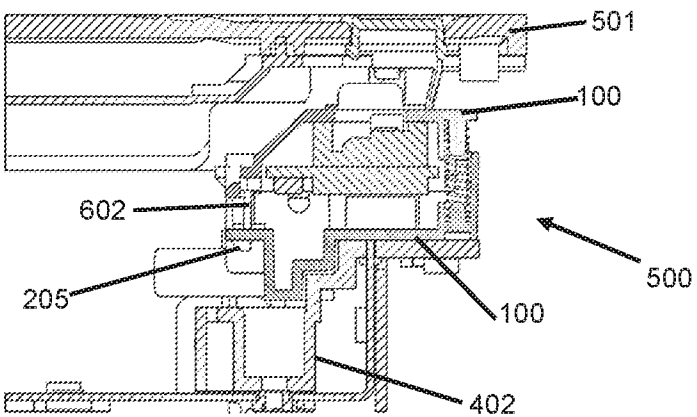

In FIG. 6D the platen 501 is then raised away from the structure 402 and is free to be removed from the greater apparatus 500, The sensor support 100 is disengaged from the platen 501 and the grips 103 removed from their location on the platen 501. The tooth 602 passes through the aperture at an extreme end of the length of the tooth 602. The tang 205 on the tooth engages with a surface of the second section 102 and prevents the first section 101 disassociating from the second section 102 as the biasing means 502 urges the sections 101, 102 apart.

It will be apparent that the platen 501 is replaced by performing the actions illustrated in FIGS. 6A to 6D in reverse. In doing so, the grips 103 re-engage with the platen 501, and the biasing means 502 urges the first section 101 towards the platen 501. The action of the grips 103 with the biasing means 502 ensures that the sensor located in the first section 101 is replaced in substantially the same location relative to the platen 501, even if the platen 501 is not substantially returned to the same position within the greater apparatus 500. Not substantially returned to the same position within the greater apparatus 500 means that the platen 501 is in a position ready to be used by an end user in the apparatus, but that the placement of the platen 501 relative to the rest of the greater apparatus 500 may not be, for one reason or another, substantially the same as a previous position of the platen 501 relative to the greater apparatus 500. As the guides 203 and slots 302 allow for both translational and rotational displacement of the platen 501 relative to the greater apparatus 500 the sensor support 100 may still replace the senor in substantially the same position relative to the platen 501 even if the platen 501 is placed in an in-use position that is askew relative to the greater apparatus 500.

In each of FIGS. 6A to 6D the platen 501 comprises an aperture 603 through which the sensor 601 in the sensor support 100 is able to sense a printing media placed and passing over the platen 501. In some examples an aperture may not be needed, and alternatives may be used, such as a cut out. In some examples a transparent window may be located at least partially within the aperture 603. Transparent in this sense means transparent to the sensor 601, so as not to inhibit the function of the sensor 601. Accordingly, the window may be transparent with respect to the interrogating signals emitted from the sensor 601 or the signals observed by the sensor 601 if no interrogating signals are emitted. The window may fill the aperture 603 completely or partially. The window may perform a protective function, preventing unintended deposition of printing liquid, ink, dust, or other printed material onto the sensor.

In some examples it may be desirable to disable the sensor, in which case a platen without an aperture may be used to block the sensor. Alternatively, the platen may be capable of communicating to the printer that the sensor should enter a specific operation state such as an on state or an off state. This may be achieved by part of the platen being arranged to contact a switch controlling an on/off state of the sensor for example. Alternatively, the sensor may be used to detect the presence of a platen without an aperture and then enter an off state.

Accordingly, in the presented examples, the platen 501 may be removed without removal of the sensor 601, This allows an end user to change a printer set up easily and negates the need for the sensor 601 to be uncoupled and subsequently recoupled. Furthermore, the sensor support 100 ensures that sensor 601 is substantially returned to the same position relative to the platen 501. This negates the need for the end user to recalibrate the sensor 601 and results in a smoother printing process. The sensor support 100 is capable of tolerating imprecise replacement of the platen 501 and can position the sensor correctly even if the platen 501 is disposed at a different distance, relative translational position, or relative rotational position to the sensor 601 compared to a previous placement of the platen 501.

In this manner the sensor support 100 can urge the sensor towards the platen 501, aligning axes of the sensor 601 within the first section 101 and the platen 501, as well as a surface of the first section body 202 substantially parallel with a surface of the platen 501. The sensor support 100 maintains the focus distance between the sensor 601 and the print media while a part (in this instance the platen 501) between the focal point and the sensor 601 needs to be removed and/or replaced without the need for recalibration of the sensor 601.

Figure 7:
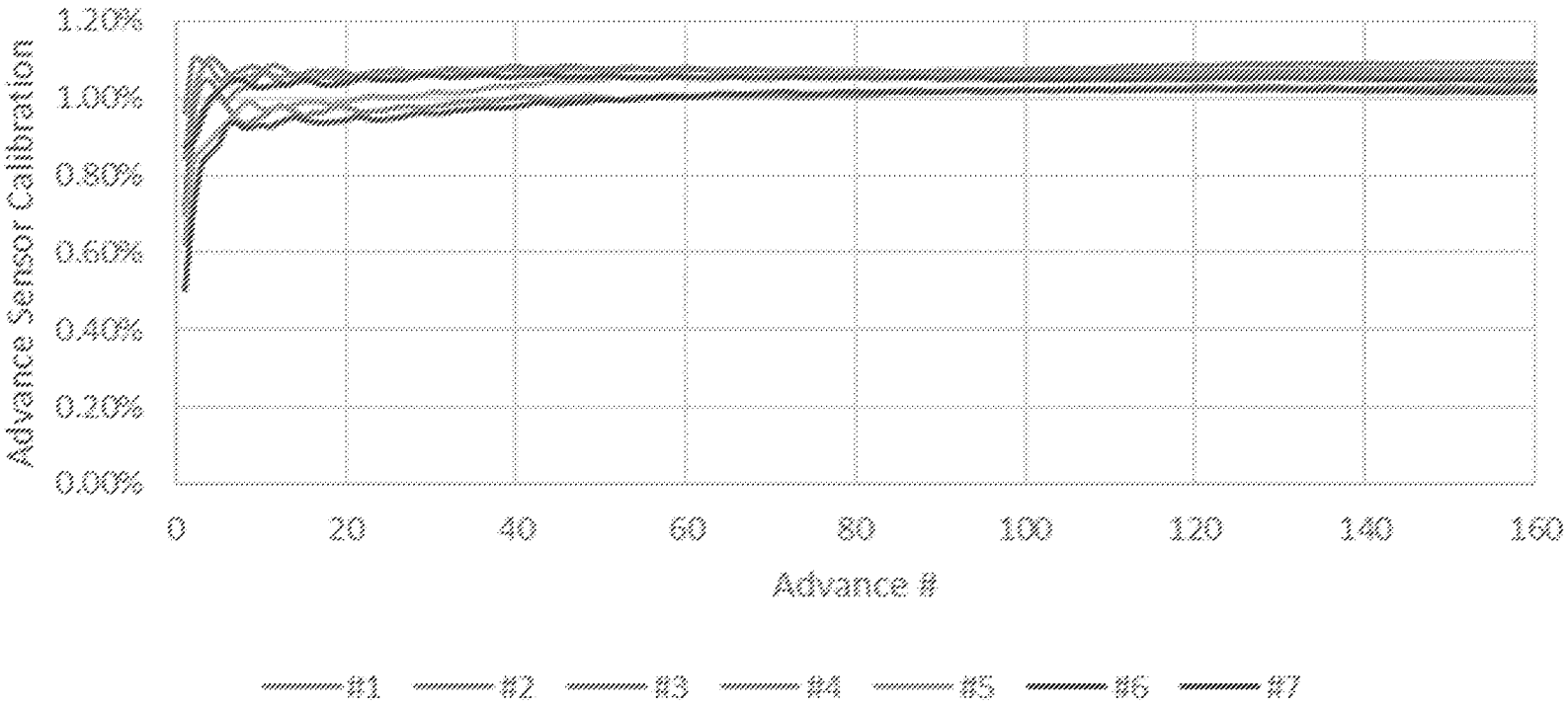
FIG. 7 shows the variability of sensor calibration of a sensor in a sensor support according to example implementations.

With reference to FIG. 7, the advance sensor calibration (FIG. 7, Y-axis) was recorded multiple times (indicated by lines #1 to #7 in FIG. 7) with the number of dots of print media advance (FIG. 7, X-axis). The variability of the sensor calibration was therefore determined following repeated platen 501 removal and replacement operations. By using the sensor support 100 of presented examples a variability of less than ±0.05% was obtained. A sensor located in the sensor support 100 was found to provide a measurement error of ±10.6 μm in 1000 dots of print media advance.

The guides and slots referred to in presented examples may be arranged on either the first section 101 or the second section 102 (e.g. the first section 101 may be provided with slots and the second section 102 may be provided with guides). The guides and slots are intended to allow a degree of freedom of movement between the first and second sections 101, 102 while keeping the first and second sections 101, 102 associated together. In other words the degree of freedom of movement is within predetermined bounds sufficient to allow the sensor support 100 to reliably and repeatably reposition a sensor relative to a sensor target (i.e. a print medium). Any suitable means may be used to provide the function of the guides and slots such as resiliently deformable members, sprung clips, resiliently deformable clips, hinges, elastic members, tethers, or springs.

The sensor may suitable be any sensor, in presented examples the sensor is a media advance sensor, such as an optical media advance sensor, for detecting the advancement of printing media through a printing system. Any sensor that needs to be replaceably maintained at a distance and orientation from a sensor target (such as the printing media in the present presented examples) may be used with the sensor support 100.

Printing media include, but are not limited to, paper, natural and man-made fabrics and/or textiles, and card. The printing media may be porous or non-porous, Porous printing media may allow a proportion of ink applied to the porous printing media to pass through and be deposited on any surface below the porous printing media.

In presented examples the biasing means 502 is presented as a spring. However, it will be apparent that any biasing means 502 may be used provided those biasing means 502 urge the first section 101 towards the platen 501 and away from the second section 102. Such biasing means 502 include, but are not limited to, springs; coil springs; shim springs; elastomers; resilient foams; and/or magnets. In the case of magnets, this may be magnets located within the first and second sections 101, 102 in a repulsive manner (i.e. like-pole to like-pole such as north-north), whereby the corresponding magnets repel one another and thus urge the first section 101 away from the second section 102. Alternately, magnets may be arranged on the platen 501 and/or first section 101 such that an attractive force is provided between the first section 101 and the platen 501, and the first section 101 is urged towards the platen 501. Accordingly, either the first section 101 or platen 501 may comprise a magnetic material and the corresponding part a magnet to attract the magnetic material. It will be apparent that either permanent or electro-magnets may be used.

Further example implementations can be realised according to the following feature sets:

Feature set 1: A sensor support comprising a first section and a second section, wherein the first section is capable of receiving a sensor, wherein the first section and the second section are associated together such that there is at least a degree of freedom of movement of the first section relative to the second section, wherein the sensor support further comprises biasing means to urge the first section away from the second section.

Feature set 2: A sensor support as described in Feature set 1 wherein the second section is integrally formed in a printer.

Feature Set 3: A sensor support as described in Feature set 2 wherein the second section is integrally formed in a chassis of a printer.

Feature Set 4: A sensor support as described in Feature set 1 further comprising a sensor, wherein optionally the sensor is an optical media advance sensor.

Feature Set 5: A sensor support as described in Feature set 1 wherein the first section further comprises at least one protrusion capable of interfacing with a platen.

Feature Set 6: A sensor support as described in Feature set 1 wherein the second section is removably attachable to a printer.

Feature Set 7: A sensor support as described in Feature set 6 wherein the second section is removably attachable to a chassis of the printer.

Feature Set 8: A sensor support as described in Feature set 6 wherein the second section snap-fits to the printer.

Feature Set 9. A sensor support as described in Feature set 1 wherein the first section and second section are associated together by respective complementary guides and slots.

Feature Set 10: A sensor support as claimed in claim 1 wherein the biasing means comprises at least one from the list of: spring; coil spring; shim spring; an elastomer; a resilient foam; and/or a magnet.

Feature Set 11: A platen for use with a sensor support as described in Feature set 1, wherein the platen comprises an aperture allowing a sensor arranged in the sensor support to sense a printing media arranged on the platen, wherein optionally a window is located at least partially in the aperture.

Feature Set 12: A platen for use with a sensor support as described in Feature set 4, wherein the platen is capable of setting an operational state of the sensor; optionally the operational states include an off state or an on state.

Feature Set 13: A printer comprising a sensor support as described in Feature set 1, wherein the printer further comprises a platen, the platen substantially abutting the sensor support, wherein the platen may be removed from the printer without removing the sensor support.

Feature Set 14: A printer as described in Feature set 13 wherein, when the printer comprises a platen, the sensor support is arranged at least partially under the platen.

Feature Set 15: A printer as described in Feature set 14 wherein in use, the biasing means urges the first section in at least one of the following ways: substantially towards the platen; to substantially align an axis of the first section with an axis of the platen; and/or to arrange a surface of the first section substantially parallel with a surface of the platen.

The invention claimed is:

1. A sensor support comprising: a first section to house a sensor and a second section, wherein the first section and the second section are associated together such that there is at least a degree of freedom of movement of the first section relative to the second section, wherein the sensor support further comprises biasing means to move the first section away from the second section.

2. The sensor support as claimed in claim 1 wherein the second section is integrally formed in a printer.

3. The sensor support as claimed in claim 2 wherein the second section is integrally formed in a chassis of a printer.

4. The sensor support as claimed in claim 1 wherein the sensor is an optical media advance sensor.

5. The platen for use with a sensor support as claimed in claim 4, wherein the platen is to set an operational state of the sensor and wherein the operational state is either an off state or an on state.

6. The sensor support as claimed in claim 1 wherein the first section further comprises at least one protrusion to interface with a platen.

7. The sensor support as claimed in claim 1 wherein the second section is removably attachable to a printer.

8. The sensor support as claimed in claim 7 wherein the second section is removably attachable to a chassis of the printer.

9. The sensor support as claimed in claim 7 wherein the second section snap-fits to the printer.

10. The sensor support as claimed in claim 1 wherein the first section and second section are associated together by respective complementary guides and slots.

11. The sensor support as claimed in claim 1 wherein the biasing means comprises at least one from the list of: spring; coil spring; shim spring; an elastomer; a resilient foam; and/or a magnet.

12. The platen for use with a sensor support as claimed in claim 1, wherein the platen comprises an aperture allowing the sensor housed in the sensor support to sense a printing media arranged on the platen, wherein optionally a window is located at least partially in the aperture.

13. A printer comprising a sensor support as claimed in claim 1, wherein the printer further comprises a platen, the platen substantially abutting the sensor support, wherein the platen may be removed from the printer without removing the sensor support.

14. The printer as claimed in claim 13 wherein, when the printer comprises a platen, the sensor support is arranged at least partially under the platen.

15. The printer as claimed in claim 14 wherein in use, the biasing means urges the first section in at least one of the following ways: substantially towards the platen; to substantially align an axis of the first section with an axis of the platen; and/or to arrange a surface of the first section substantially parallel with a surface of the platen.

* * * * *